US005613787A

United States Patent [19]

Passer et al.

[11] Patent Number: 5,613,787

[45] Date of Patent: Mar. 25, 1997

[54] AUTOMATIC JOURNAL LOADING ASSEMBLY

[75] Inventors: Barry E. Passer, Newfield; Michael Smith; Robert Delaney, both of Ithaca, all of N.Y.

[73] Assignee: Axiohm IPB Inc., Ithaca, N.Y.

[21] Appl. No.: 617,255

[22] Filed: Mar. 18, 1996

[51] Int. Cl.[6] ..... B41J 15/04

[52] U.S. Cl. ..... 400/613.1; 242/332.8

[58] Field of Search ..... 400/613, 613.1, 400/614, 617, 250; 101/288; 226/91, 92; 242/332, 332.1, 332.2, 332.3, 332.4, 332.5, 332.8

[56] References Cited

U.S. PATENT DOCUMENTS 3,433,143 3/1969 Liesei et al. ..... 242/332.8
4,709,873 12/1987 Smith et al. ..... 242/332.8
4,772,146 9/1988 Saito et al. ..... 400/613.1

FOREIGN PATENT DOCUMENTS 179277 6/1994 Japan ..... 400/613.1

*Primary Examiner*—Ren Yan
*Attorney, Agent, or Firm*—Salzman & Levy

[57] ABSTRACT

A journal printing apparatus is disclosed for a journal receipt printing machine. The apparatus semi-automatically loads the journal paper onto the take-up spool. The machine is also characterized by drop-in loading for the journal paper supply roll. The journal printing apparatus utilizes a duckbill take-up core or spool that is bifurcated into stationary and movable sections. The bifurcated spool is spring loaded, and is caused to bias closed by movement of a cam. The leader of the journal paper is placed over the stationary section of the spool and a gear train causes the cam to rotate again. The gear train then forces the duckbill spool shut against its biasing, thus capturing the paper between the spool sections. In this fashion, the procedure of journal paper resupply is accomplished without the user having to thread paper.

10 Claims, 7 Drawing Sheets

AUTOMATIC JOURNAL LOADING ASSEMBLY

FIELD OF THE INVENTION

The present invention relates to retail receipt printing mechanisms, and, more particularly, to a retail receipt printer whose transaction journal can be loaded without performing a manual threading procedure.

BACKGROUND OF THE INVENTION

It has recently become useful to validate customer checks at retail establishments and shopping markets. Small desk top and counter top machines both print receipts for transactions and validate customer checks and other documents of legal tender. In addition to the printing of receipts for transactions, these machines often keep a record, or journal, of such transactions on a separate roll of journal paper, which is unloaded when completely used, but not distributed to the customer(s). One such machine is a Model No. 7221 printer manufactured by Axiohm Corporation, Ithaca, N.Y.

Other commercially available machines of this type usually require cumbersome, manual threading of their receipt supply rolls, and their journal rolls, which record all of the store commercial transactions.

The Axiohm machine, however, comprises a means by which the receipt paper supply roll can merely be dropped into a paper supply bin disposed in the housing without the need for customer manual receipt threading. Moreover, this machine is a one-station device. That is, only one movable print head and one paper path is used to print on a single supply of two-ply paper. One sheet is severed for customer receipts, and the other forms the continuous journal paper roll.

Drop-in loading of a receipt paper supply roll is already known, and has proven most useful to personnel working in the store, especially when the supply of paper runs out during busy store hours. The drop-in feature for receipt paper allows for quick resupply without manual threading, thus preventing all but a minimum delay at the check-out counter.

It makes no sense, however, to streamline the customer receipt paper loading procedure without doing the same for journal paper loading. This is so because any prolonged procedure during customer check-out is anathema to efficient store management.

Journal printing has always been an especially difficult procedure. Most, if not all, receipt printing machines require the user or operator to remove the rewinding core and then thread the end of a new roll of journal paper through an opening therein. The core or spool is then hand-rotated in order to capture the journal paper on the core. The whole procedure is not unlike the hand threading of movie film in obsolete cameras.

Despite the desire to achieve threadless journal paper loading, however, the problem has proven vexatious; an effective result was most difficult to achieve. The present invention, however, solves this problem. In addition to paper supply drop-in capability, this invention has developed a means by which the record keeping journal can be loaded without requiring operating personnel to engage in manual paper threading.

It is an object of the invention to provide an improved journal printing apparatus.

It is another object of this invention to provide a loading method for the journal paper take-up spool without requiring manual paper threading.

It is a further object of the invention to provide a journal printing apparatus having a more automatic journal paper resupply, allowing for drop loading of the supply paper.

The present invention includes a means by which the journal paper is quickly and easily drop-loaded into its supply bin. The leader of the supply roll is captured in feed rolls, as the cover of the machine is closed, and then deposited over the take-up core. This is accomplished without removing the take-up core, and without any concern for its position. In other words, by using this invention, the core is semi-automatically threaded. All the user need do is close the cover over the supply bin and press the paper advance switch after the supply roll is deposited in the bin.

The take-up core of the invention features a novel bifurcated "duckbill" spool, that is split lengthwise approximately in half. The paper is deposited over the first half of the open spool, and then the complementary portion of the spool is caused to close over the paper, thus capturing it. The closing of the bifurcated spool is triggered by movement of a cam that causes the first portion of the spool to descend. The cam is rotated one turn when the paper roll bin is closed.

Similarly, the first portion of the spool is spring-biased when the paper roll bin is opened, thus causing the first portion of the spool to open, relative to the second portion of the spool.

Closing or opening the clamshell initiates movement of a gear drive train that actuates the cam motion. The gear train movement is initiated by a toothed rack mounted in the printer itself. A rack and gear configuration in a clamshell environment, although used for a different purpose (for taking up slack and tightening paper), is disclosed in U.S. Pat. No. 5,219,236, issued to Kamimura et al for "Recording Apparatus Capable of Recording Information on Both a Continuous Recording Medium and a Cut-Sheet Recording Medium". No duckbill spool is shown in the Kamimura reference, however. In fact, the spool and drive train in that reference move in a direction opposite to that of the present invention.

SUMMARY OF THE INVENTION

In accordance with the present invention, there is provided a journal printing apparatus for a check validating and customer receipt printing machine that loads journal paper onto a take-up roll without manual paper threading. The machine is also characterized by a drop-in loading for the journal paper supply roll. The journal printing apparatus comprises a take-up core or spool that is bifurcated into a stationary and a movable portion. (The terms "stationary" and "movable" are used herein to describe the spool portions' angular movement with respect to one another only, since both portions actually rotate about a common axis, as is described hereinbelow.)

The bifurcated spool is spring-loaded in an open position, but is caused to bias to its closed position by movement of a cam. The journal paper roll bucket is opened by the user in order to drop load the journal paper into the paper supply bin. The spool forms a duckbill, when the rotating cam allows the movable spool portion to separate from the stationary spool portion. The two portions of the spool, when separated from each other to their greatest extent, form approximately a 60° or greater angle.

The user opens the clamshell housing and removes, from the paper supply bin, the spent core which had held the paper supply. Then the user slides the rewound, printed journal roll of paper from the rewind core, and, after unwinding a four- or five-inch leader of paper, places a new supply roll in the paper supply bin. The paper roll placing or "dropping" operation is from whence the term "drop-in loading" is derived. The leader is simply laid over the feed rolls and the user closes the clamshell.

As the clamshell closes, the gears that are mounted on it turn the empty rewind spool and core one full revolution backwards (i.e., in the direction opposite forward motion of the paper when printing on it). During this backwards revolution, the spring-loaded duckbill spool passes the position in which it can spring open. The spool therefore springs open and is prevented from turning further in the backward direction. The rewind clutch slips until the clamshell is closed; the clutch disengages the rack, engaging the drive train. Now, the user simply lays the leader over the horizontal portion of the rewind spool and pushes the paper advance button, so that the drive motor advances the rewind spool in the forward direction. The cam on the rewind spool bearing closes the spool and captures the leader.

In this fashion, the whole procedure of journal paper resupply is accomplished with five simple operator steps: (1) open the cover and paper supply clamshell disposed in the printer housing, (2) drop load a paper supply roll into the paper supply bin; (3) close the clamshell; (4) lay the paper leader over the stationary portion of the rewind duckbill spool; and (5) press the paper advance button to capture the leader and initiate the paper take-up procedure.

BRIEF DESCRIPTION OF THE DRAWINGS

A complete understanding of the present invention may be obtained by reference to the accompanying drawings, when considered in conjunction with the subsequent detailed description, in which.

For the sake of brevity and clarity, all like components and elements of this invention will bear the same numerical designations throughout the FIGURES.

DESCRIPTION OF THE PREFERRED EMBODIMENT

Generally speaking, the invention features a journal printing apparatus for semi-automatically loading journal supply paper onto a take-up roll in a check validating and customer receipt printing machine. The apparatus is also characterized by means for drop loading the paper supply roll into the printing machine. In this fashion, the whole journal printing procedure is greatly simplified, such that the delays at the check-out counter in retail establishments due to paper resupply will now be a thing of the past.

Figure 1:
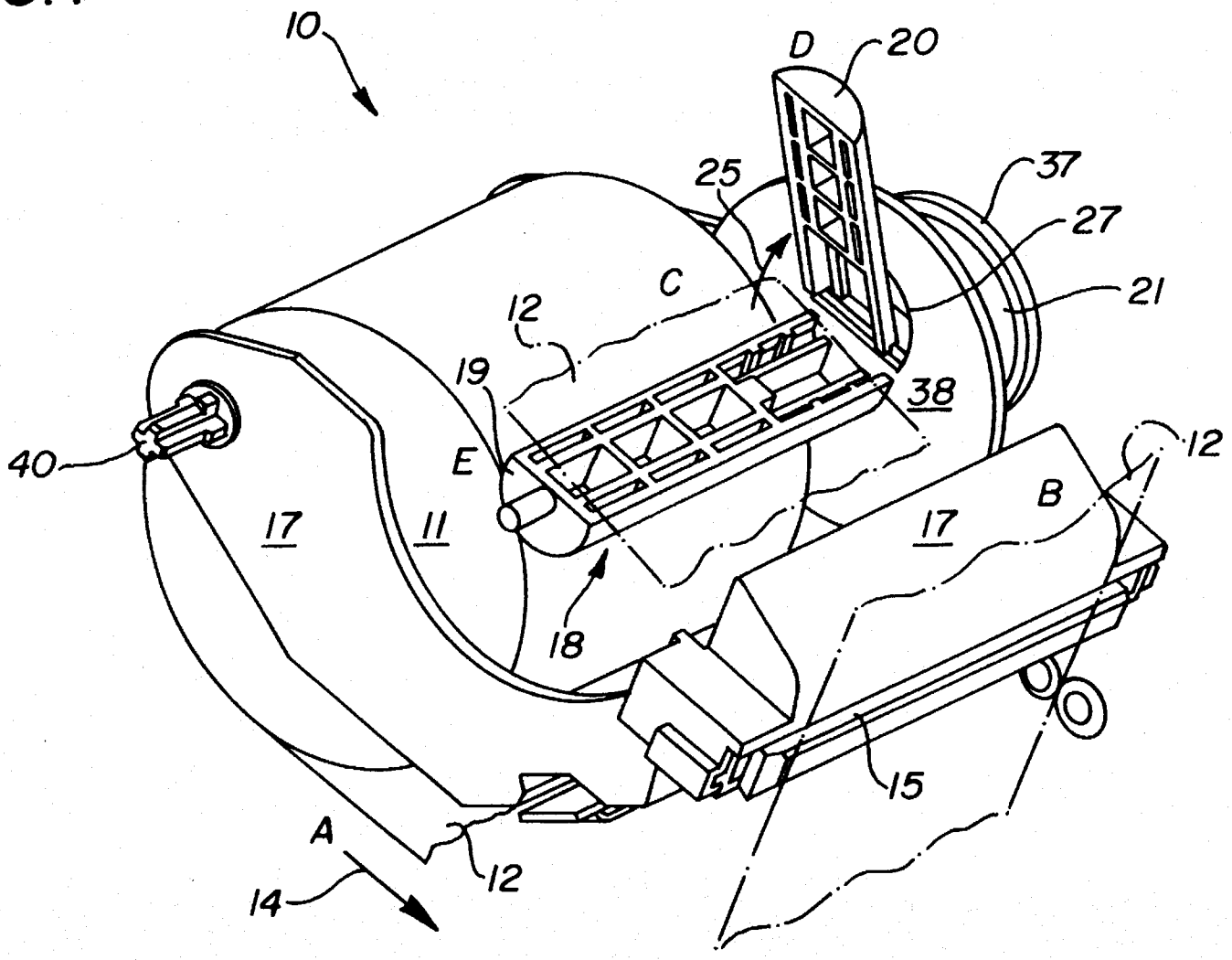
FIG. 1 illustrates a lefthand, perspective view of the threadless journal paper loading apparatus of this invention.
Figure 2:
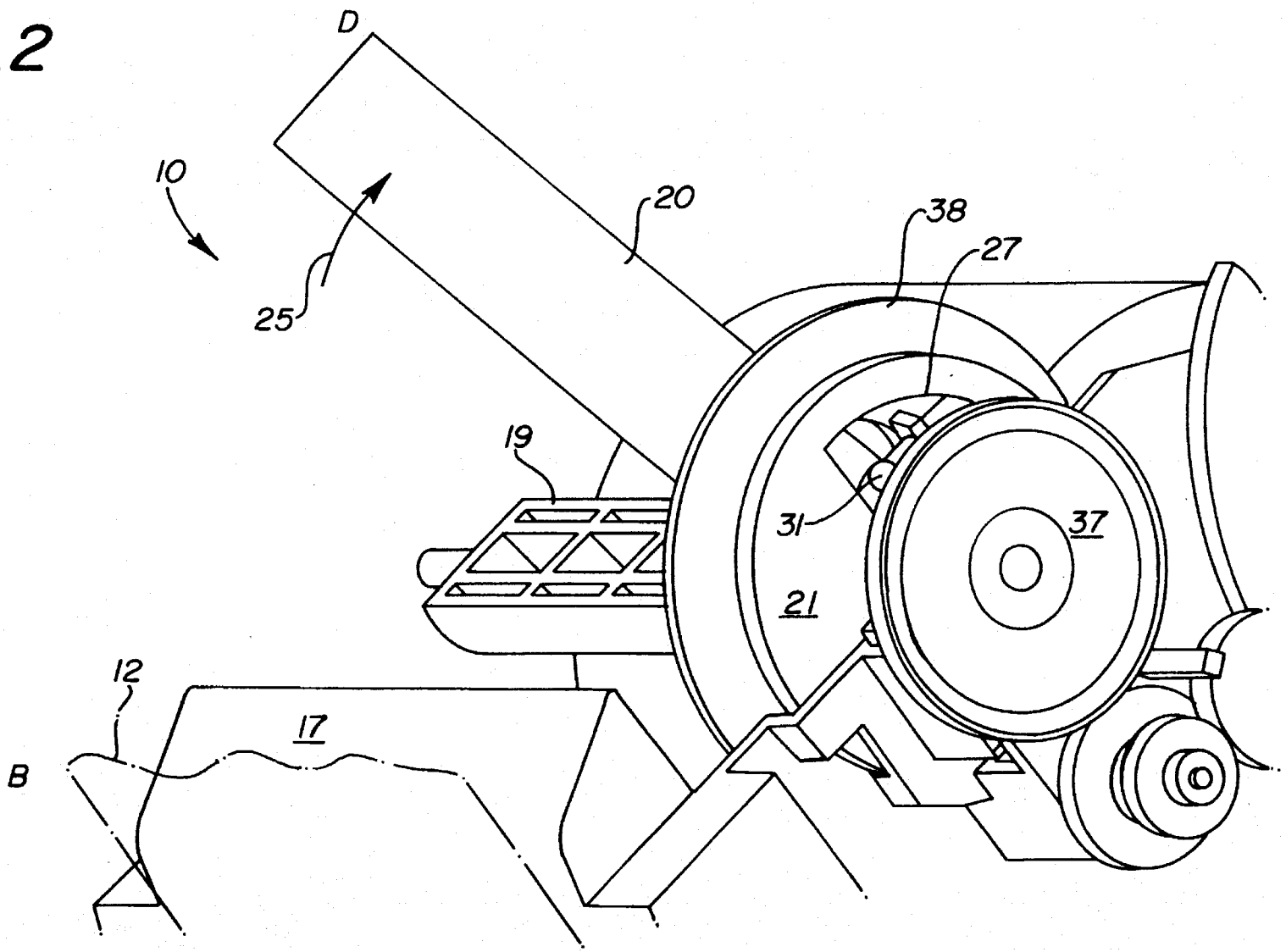
FIG. 2 depicts a righthand, perspective view of the the journal paper loading apparatus of this invention.

Now referring to FIGS. 1 and 2, the journal paper loading apparatus 10 of this invention is illustrated. The journal loading apparatus 10 utilizes a drop-loaded supply roll of journal paper 11. When a receipt printing function is also required, the paper is two-ply, with pressure sensitive paper used for the journal printing function. A hinged cover (not shown) is opened in typical Axiohm receipt printing and check validating machines to expose a paper supply bin (not shown), which is a hollowed out portion of the printer housing. A clamshell 17 must be opened to accept the paper supply roll 11. The paper supply roll 11 is merely dropped into the exposed paper supply bin. A typical Axiohm construction is illustrated in a copending United States patent application, Ser. No. filed ..... ; attorney docket No. AXI-7193.

After the supply roll of journal paper 11 is deposited into the paper supply bin of the machine, a leader of paper 12 is withdrawn (arrow 14) at Position A, and directed past the printing platen 15, over the top of the clamshell 17 at Position B, and thereafter deposited between the two portions of the open, bifurcated, take-up, duckbill spool 18, at Position C.

The open, bifurcated, take-up spool 18 comprises a fixed or stationary section 19, and a movable section 20, shown here in its open, 60° (minimum) angled position with respect to stationary section 19. Stationary section 19 is molded to flange 38. The stationary spool section 19 is mounted for subsequent rotation in a bearing 21, attached to take-up gear 37, which rotates the spool 18 to effectuate take-up or rewinding of the printed journal, after the paper leader 12 has been captured between the respective spool sections 19 and 20.

In assembling the printer, the take-up spool 18, which comprises stationary and movable sections 19 and 20, respectively, is inserted into bearing 21. Take-up gear 37 is attached to take-up spool 18. This assembly is then snapped into the clamshell 17. A compound gear and slip clutch, described hereinbelow, are then also snapped into the clamshell 17. Thus, all of the aforementioned components are mounted on and travel with the clamshell 17.

Figure 4:
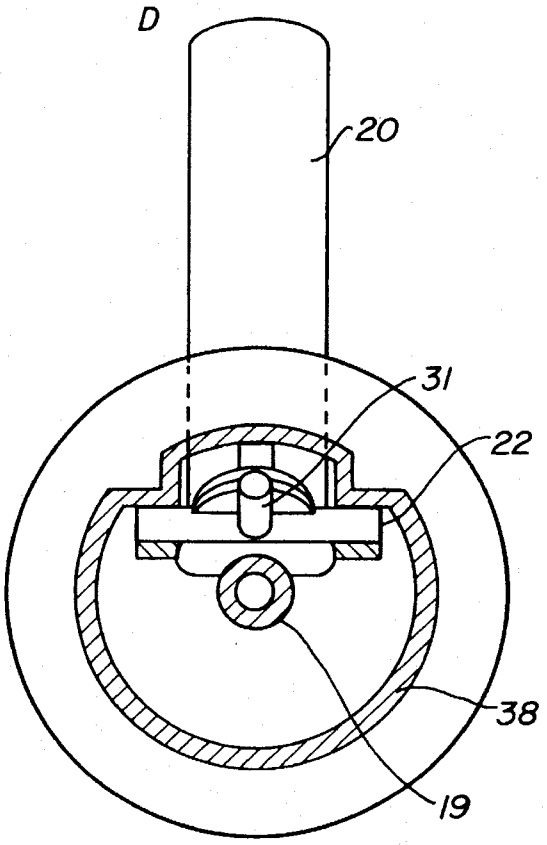
FIG. 4 depicts a sectional side view of the camming device shown in FIG. 3.
Figure 3A:
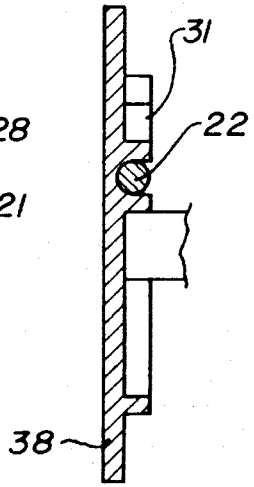
FIG. 3*a* illustrates a sectional view of the camming device shown in FIG. 3, with the camming device in its forwardly rotated cam position.
Figure 3:
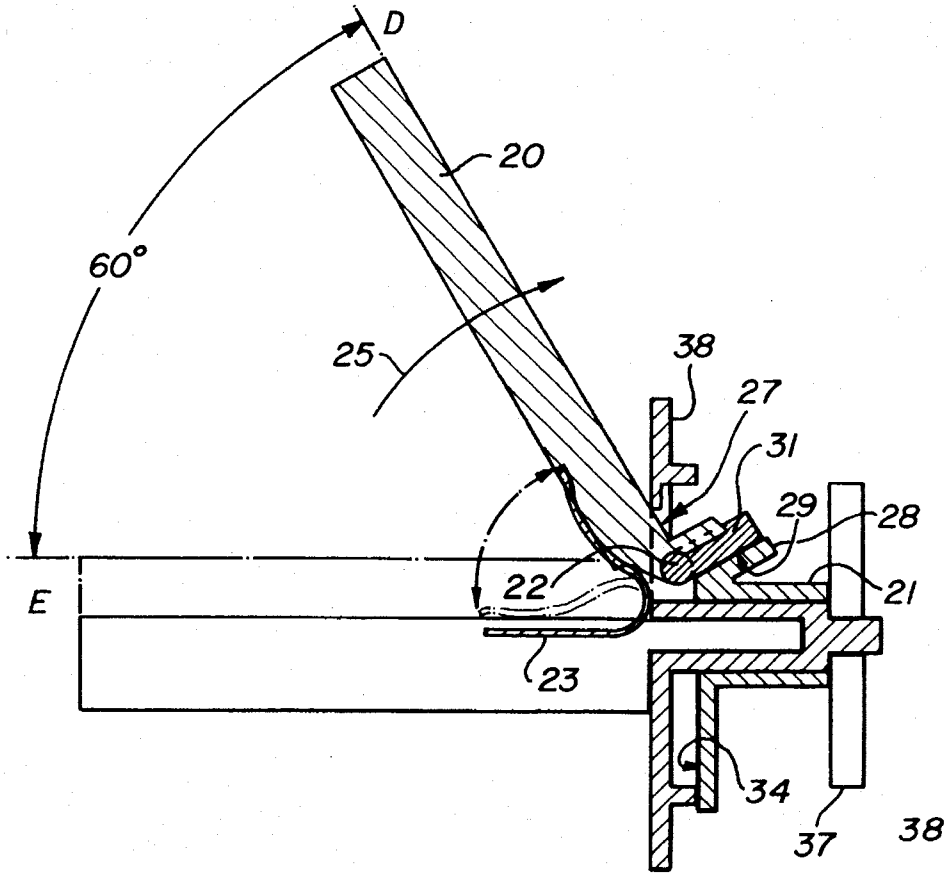
FIG. 3 shows a front sectional view of a camming device used to operate the take-up spool, with the camming device shown in its reverse rotated position.
Figure 5:
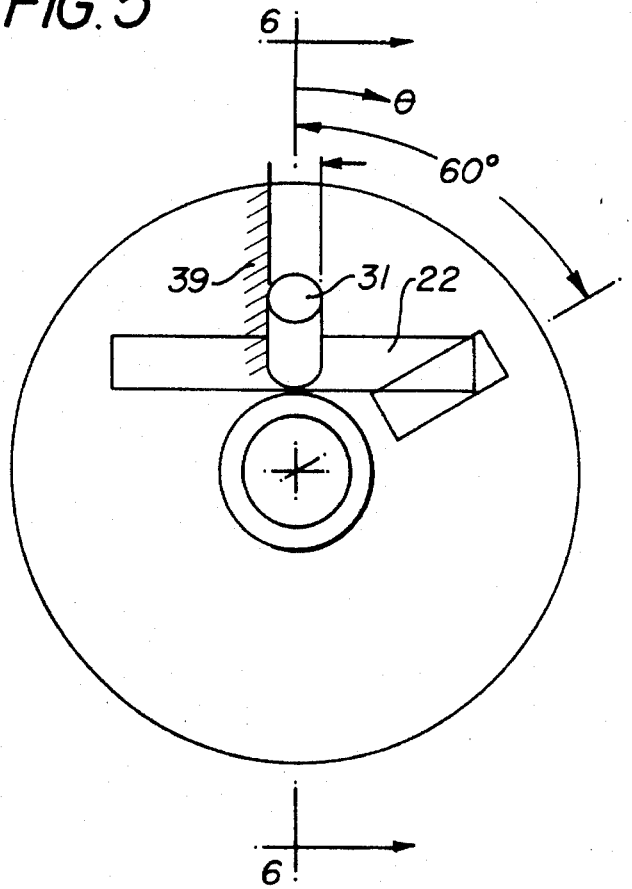
FIG. 5 depicts another front view of the camming device of FIG. 4.
Figure 6:
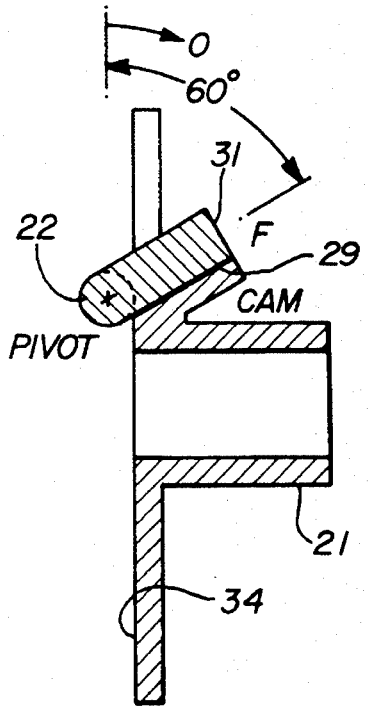
FIG. 6 depicts another sectional side view of the camming device of FIG. 3.

Referring to FIGS. 3, 3*a* and 4, the movable spool section 20 is shown pivotably movable about rotational pin 22. (FIGS. 5 and 6 depict yet another view of the spool 18 and cam assembly shown in FIGS. 3, 3*a* and 4.) A leaf spring 23 causes the upper, movable spool section 20 to be biased (arrow 25) toward the 60°, open Position D, as illustrated.

The movable spool section 20 projects through a window 27 formed in flange 38.

Figure 9:
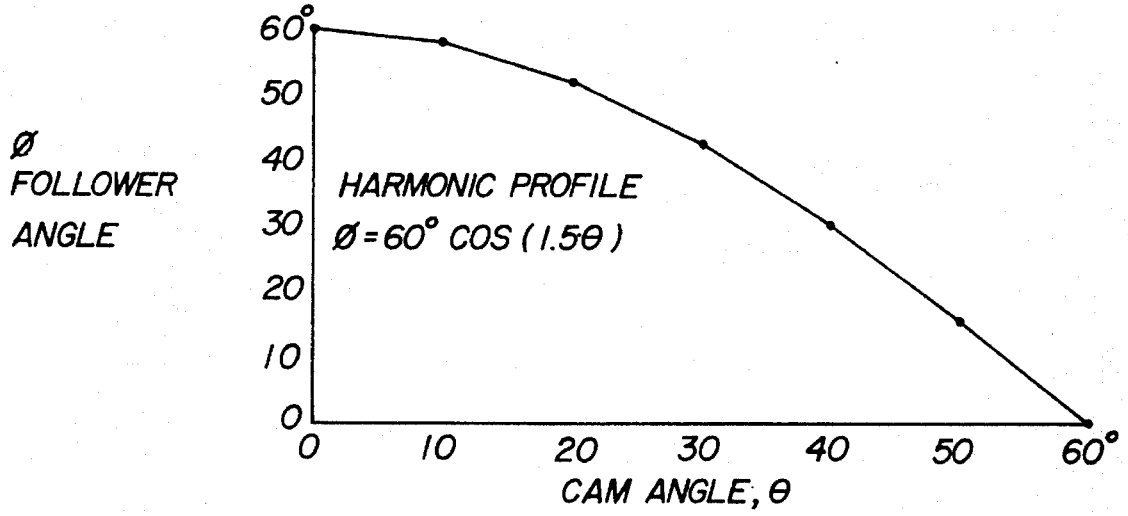
FIG. 9 is a graphical representation of cam angle vs. follower angle of the camming device of the present invention.
Figure 7:
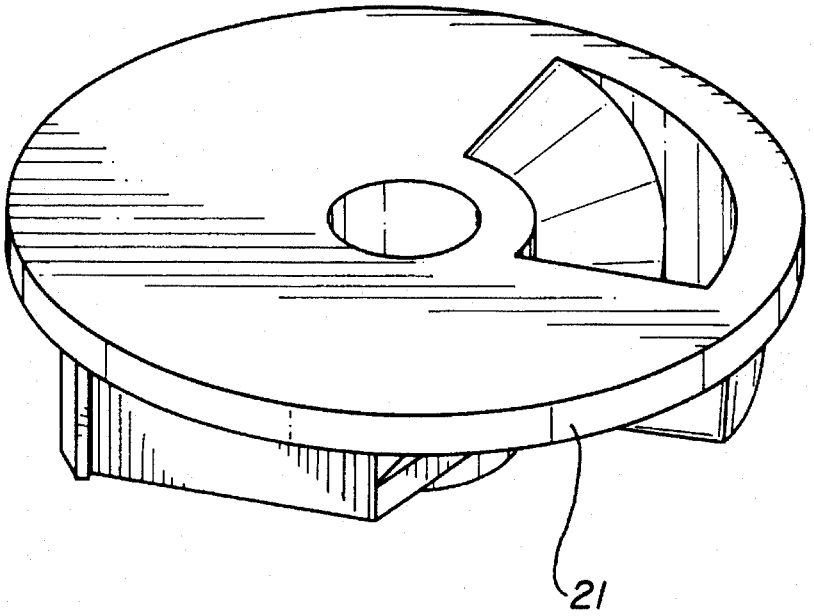
FIG. 7 is a top perspective view of the bearing and cam surface assembly of the present invention.
Figure 8:
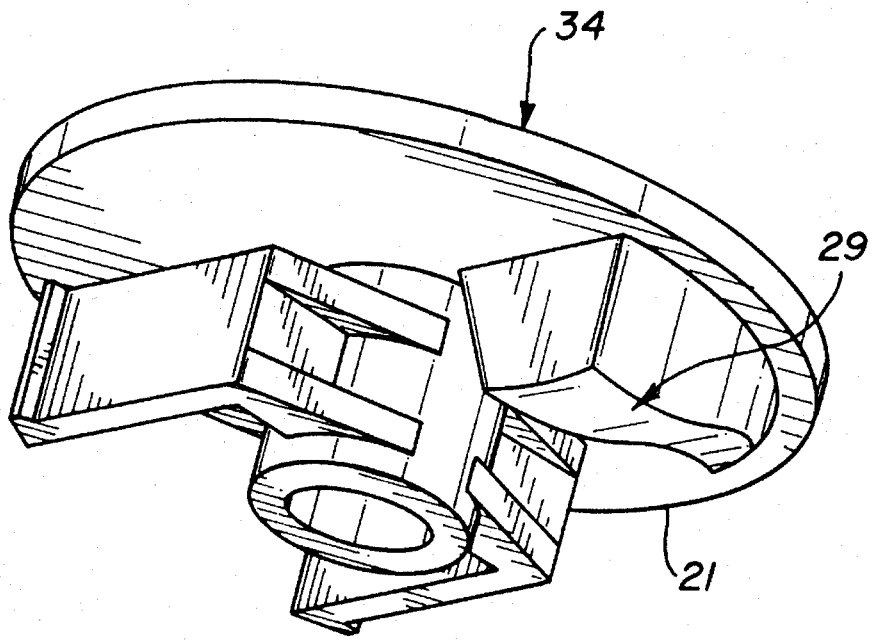
FIG. 8 is a bottom perspective view of the assembly shown in FIG. 7.

A cam 28 is disposed immediately adjacent and part of the bearing 21, and is utilized to cam the spool section 20 against its biasing spring 23, toward contact with the stationary spool section 19, in order to capture the paper leader 12 between the two spool portions 19 and 20 of the duckbill spool 18. The cam 28 comprises follower surfaces 29 and 34 (see also FIGS. 7 and 8, which depict the upper and lower views of bearing 21, respectively) that allow contact with the 90° follower 31 projecting from spool section 20. The follower 31 moves along surface 29. When moving in the forward direction of rotation, follower 31 runs up surface 29 to surface 34, where it is fully closed. The profile of surface 29 (FIG. 9) indicates that when cam follower 31 reaches its fully opened position F, follower 31 comes up against a stop 39 in bearing 31, preventing further motion in the backwards direction. The duckbill spool 20 is opened, position D, and remains open.

Figure 10:
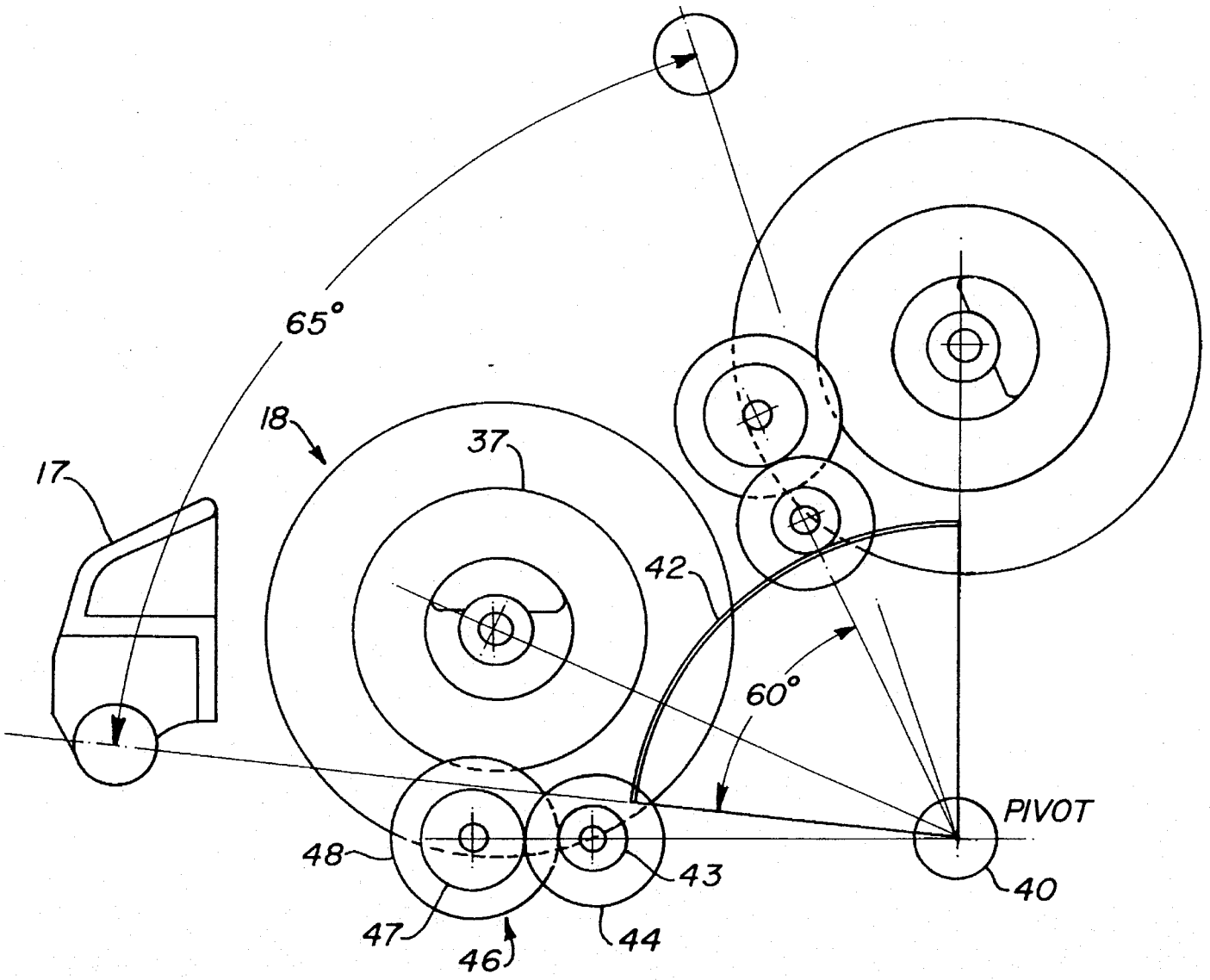
FIG. 10 is a righthand schematic representation of the gear train of the openable spool, shown in open clamshell and closed clamshell configurations.

Referring now also to FIG. 10, there is shown a righthand view of the gear train used in the preferred embodiment. When the clamshell 17 is rotated about pivot 40 and closed, covering the paper roll supply bin, a toothed rack 42, forming a minimum of a 60° portion of a circle, engages with the inner teeth 43 of a compound gear 44. The compound gear 44 is used not only to reverse direction of the rotary motion of the train, but also to increase the gear ratio, so that partial travel along the toothed rack circle portion 42 results in at least one complete rotation of the take-up spool 18.

A fixed torque (wrapped spring) slip clutch 46 is disposed between the compound gear 44 and the take-up gear 37. This slip clutch 46 allows "overdriving" of the take-up spool 18, in either direction. In other words, slip clutch 46 absorbs rotational energy in its internal spring (not shown) so as to ensure that the spool 18 is cammed to its completely opened position, but not overcammed to a partially closed one. During assembly of the printer, both compound gear 44 and slip clutch 46 are snapped onto the clamshell 17 after the rewind spool 18 and take-up gear 37 subassembly is attached thereto.

Figure 11:
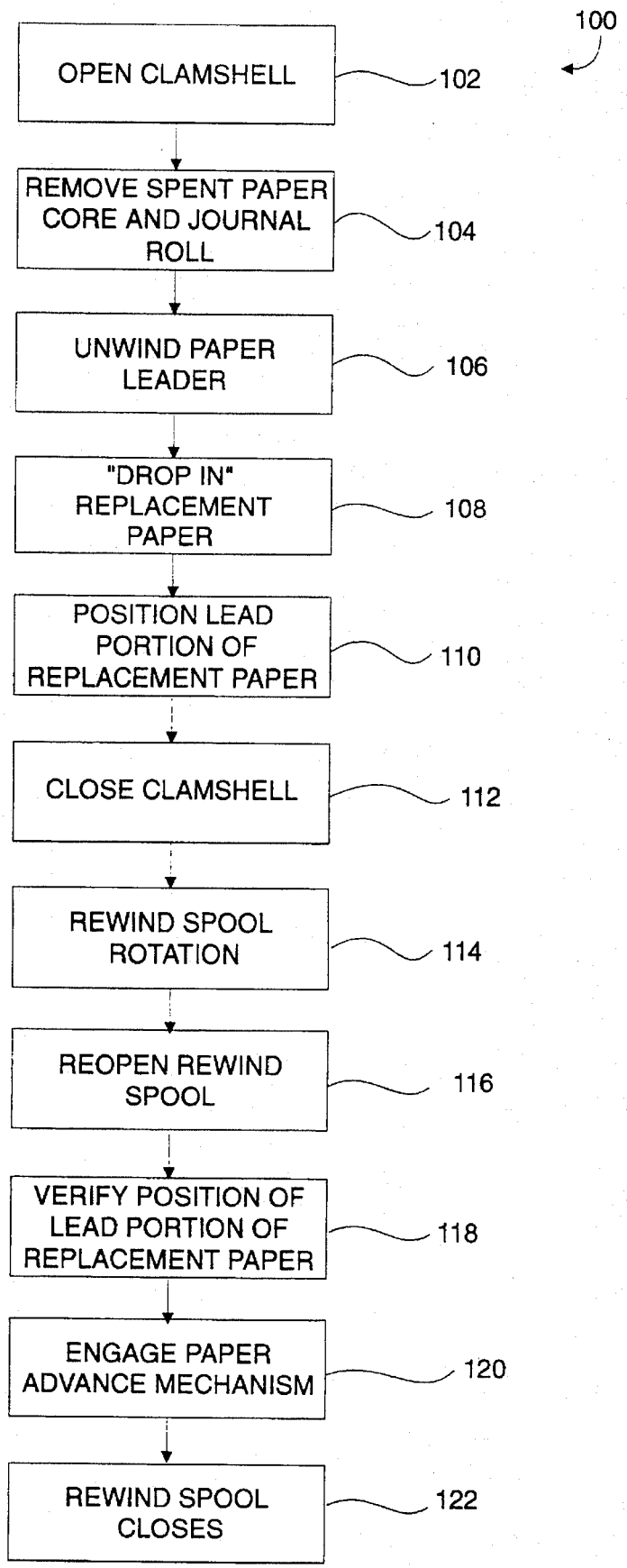
FIG. 11 is a flow chart depicting the method of using the threadless paper journal loading apparatus, depicted in FIGS. 1 through 8.

Referring now to FIG. 11, a flow chart 100 of the method of this invention is shown, using the paper loading apparatus illustrated throughout the FIGS. 1 through 8 and 10. In operation, the user opens the clamshell 17, step 102, and removes, from the paper supply bin, the spent paper core which had held the paper supply. Then the user slides the rewound, printed journal roll of paper from the rewind core, step 104. After unwinding a four- or five-inch leader of paper 12, step 106, the user places a new supply roll 11 in the paper supply bin, step 108. The operation of placing or "dropping" the paper roll 11 is from whence the term "drop-in loading" is derived. The leader 12 is simply laid over the feed rolls, step 110, and the user closes the clamshell 17, step 112.

As the clamshell 17 (FIG. 10) closes, step 112, the gears that are mounted on it turn the empty rewind spool 18 and core one full revolution backwards, step 114 (i.e., in the direction opposite forward motion of the paper when printing on it). Specifically, toothed rack 42 drives the input 43 of compound gear 44, which is attached to the clamshell 17. The output of compound gear 44 drives the input 47 of slip clutch 46. The output 48 of slip clutch 46 drives take-up gear 37, to drive spool 18 in the backwards direction. In this backwards direction, follower 31 rides down surface 29 until it hits stop 39.

During this backwards revolution, step 114, the spring-loaded duckbill spool 18 passes the position in which it can spring open. The spool 18 therefore springs open, step 116, and is prevented from turning further in the backward direction. The rewind clutch 46 slips until the clamshell 17 is closed; the clutch 46 disengages the rack, engaging the drive train. Now, the user simply lays the leader 12 over the horizontal, stationary portion 19 of the rewind spool 18, step 118, and pushes the paper advance button, not shown, step 120, so that the drive motor, not shown, advances the rewind spool 18 in the forward direction. The cam on the rewind spool bearing 21 closes the spool 18, step 122, and captures the leader 12.

It should be understood that there are many ways to actuate or activate the cam drive other than a switch or the opening of a clamshell or cover. The cam drive can be automatically actuated by a print command signal, for example. Such modifications will normally present themselves to the skilled practitioner.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A journal receipt printing apparatus for automatically threading the journal supply paper onto a take-up roll, in a journal receipt printing machine, comprising:

paper deposit means for drop loading a supply of journal paper into said journal receipt printing machine;

a bifurcated, take-up spool adjacent said paper deposit means for receiving a leader of said supply of journal paper in an open position, and then capturing said leader of said supply of journal paper in a closed position, said bifurcated take-up spool including a stationary section and a moveable section, said moveable section moving between said open position and said closed position; and drive means in operative contact with said moveable section of said take-up spool for moving said moveable section of said take-up spool from between said open position and said closed position, in order to receive and capture said leader of said supply of journal paper.

2. The journal receipt printing apparatus in accordance with claim 1, further comprising biasing means in operative contact with said moveable section of said bifurcated take-up spool, for biasing said moveable section towards said open position.

3. The journal receipt printing apparatus in accordance with claim 1, wherein said bifurcated take-up spool includes a clamshell-like configuration.

4. The journal receipt printing apparatus in accordance with claim 2, wherein said drive means comprises a cam positioned adjacent said bifurcated take-up spool, said cam having a follower surface that allows the moveable section of said spool to move to said open position under the influence of said biasing means.

5. A journal receipt printing apparatus for automatically threading the journal supply paper onto a take-up roll, in a journal receipt printing machine, comprising:

paper deposit means for drop loading a supply of journal paper into said journal receipt printing machine;

a bifurcated, take-up spool adjacent said paper deposit means for receiving a leader of said supply of journal paper in an open position, and then capturing said leader of said supply of journal paper in a closed position, said bifurcated take-up spool including a stationary section and a moveable section, said moveable section moving between said open position and said closed position;

drive means in operative contact with said moveable section of said take-up spool for moving said moveable section of said take-up spool from between said open position and said closed position, in order to receive and capture said leader of said supply of journal paper; and biasing means in operative contact with said moveable section of said bifurcated take-up spool, for biasing said moveable section towards said open position.

6. The journal receipt printing apparatus in accordance with claim 5, wherein said bifurcated take-up spool includes a clamshell-like configuration.

7. The journal receipt printing apparatus in accordance with claim 5, wherein said drive means comprises a cam positioned adjacent said bifurcated take-up spool, said cam having a follower surface that allows the moveable section of said spool to move to said open position under the influence of said biasing means.

8. A method of automatically threading a take-up spool of a journal printing apparatus, comprising the steps of:

a) drop loading a supply roll of printing paper into a journal printing apparatus;

b) feeding a leader from said supply roll to an open duckbill configured take-up spool having bifurcated sections, and depositing said leader between said bifurcated sections in an open take-up position; and c) closing said duckbill configured take-up spool upon said leader, thus capturing said leader between said bifurcated sections, whereby said leader of said supply roll of printing paper is automatically threaded to said take-up spool.

9. The method in accordance with claim 8, further comprising the step of:

d) opening said bifurcated sections of said duckbill configured take-up spool prior to the feeding step (a).

10. The method in accordance with claim 8, further comprising the step of:

d) after said closing step (c), rotatively advancing said duckbill configured take-up spool with said captured leader in order to wind the journal paper upon the take-up spool.

* * * * *